US011833814B2

(12) United States Patent
Burkatovsky

(10) Patent No.: US 11,833,814 B2
(45) **Date of Patent: *Dec. 5, 2023**

(54) CALIBRATION OF RUNOUT ERROR IN A DIGITAL PRINTING SYSTEM

(71) Applicant: LANDA CORPORATION LTD., Rehovot (IL)

(72) Inventor: Vitaly Burkatovsky, Rishon Lezion (IL)

(73) Assignee: LANDA CORPORATION LTD., Rehovot (IL)

( * ) Notice: Subject to any disclaimer, the term of this patent is extended or adjusted under 35 U.S.C. 154(b) by 0 days.

This patent is subject to a terminal disclaimer.

(21) Appl. No.: 17/963,225

(22) Filed: Oct. 11, 2022

(65) Prior Publication Data

US 2023/0037462 A1 Feb. 9, 2023

Related U.S. Application Data

(63) Continuation of application No. 16/765,878, filed as application No. PCT/IB2018/058895 on Nov. 13, 2018, now Pat. No. 11,511,536.

(60) Provisional application No. 62/590,672, filed on Nov. 27, 2017.

(51) Int. Cl.

| | |
|---|---|
| ***B41J 2/005*** | (2006.01) |
| ***B41J 3/46*** | (2006.01) |
| ***B41J 11/00*** | (2006.01) |
| ***B41J 11/13*** | (2006.01) |

(52) U.S. Cl.

CPC ..... *B41J 2/0057* (2013.01); *B41J 3/46* (2013.01); *B41J 11/008* (2013.01); *B41J 11/13* (2013.01)

(58) Field of Classification Search

CPC . B41J 2/0057; B41J 3/46; B41J 11/008; B41J 11/13

See application file for complete search history.

(56) References Cited

U.S. PATENT DOCUMENTS

| | | | | |
|---|---|---|---|---|
| 4,172,231 | A | 10/1979 | D'Alayer | |
| 5,433,541 | A | 7/1995 | Hieda et al. | |
| 6,605,919 | B1 | 8/2003 | Branecky | |
| 11,511,536 | B2 * | 11/2022 | Burkatovsky | B41J 2/0057 |
| 2003/0049065 | A1 | 3/2003 | Barrus et al. | |
| 2004/0124831 | A1 | 7/2004 | Micke et al. | |

(Continued)

*Primary Examiner* — Henok D Legesse

(74) *Attorney, Agent, or Firm* — KLIGLER & ASSOCIATES PATENT ATTORNEYS LTD

(57) ABSTRACT

Printing apparatus (20) includes a continuous blanket (24) and a set of motorized rollers (31), which advance the blanket at constant speed through an image area. Print bars (38) eject droplets of ink at respective locations onto the blanket in the image area. Monitoring rollers (42), in proximity to the locations of the print bars, contact the blanket to be rotated by blanket advancement. Each monitoring roller includes an encoder (44), which outputs a signal indicative of a rotation angle of the monitoring roller. A control unit (40) collects, during a calibration phase, the signal from the encoders over multiple rotations of the monitoring rollers, detects a deviation of the signal from the encoder relative to a clock signal having a predefined frequency, and computes runout correction factors. During an operational phase, the control unit applies the runout correction factors to synchronize the droplets ejection from the print bars.

15 Claims, 3 Drawing Sheets

(56) References Cited

U.S. PATENT DOCUMENTS

| | | | | |
|---|---|---|---|---|
| 2009/0196670 | A1 | 8/2009 | McNestry et al. | |
| 2011/0063355 | A1* | 3/2011 | Eun | B41J 29/393 347/16 |
| 2013/0033554 | A1 | 2/2013 | Bouverie et al. | |
| 2014/0132698 | A1 | 5/2014 | Lakin | |
| 2014/0225970 | A1 | 8/2014 | Lakin et al. | |

* cited by examiner

CALIBRATION OF RUNOUT ERROR IN A DIGITAL PRINTING SYSTEM

CROSS-REFERENCE TO RELATED APPLICATION

This application is a continuation application of U.S. patent application Ser. No. 16/765,878 filed May 21, 2020, which is a national phase of PCT Application PCT/IB2018/058895 filed Nov. 13, 2018, which claims the benefit of U.S. Provisional Patent Application 62/590,672, filed Nov. 27, 2017.

The disclosures of all these related applications are incorporated herein by reference.

FIELD OF THE INVENTION

The present invention relates generally to digital printing systems, and particularly to apparatus and methods for enhancing the precision of digital printing.

BACKGROUND

Some digital printing systems use a flexible, moving intermediate transfer member (ITM), referred to herein as a "blanket." A system of this sort is described, for example in PCT International Publication WO 2013/132424, whose disclosure is incorporated herein by reference. An ink image is formed on a surface of the moving ITM (for example, by droplet deposition at an image forming station) and subsequently transferred to a substrate, such as a sheet or roll of paper or plastic (at a transfer station). To transfer the ink image to the substrate, the substrate is pressed between at least one impression cylinder and a region of the moving ITM where the ink image is located.

High-quality printing requires precise registration between the droplet deposition heads and the moving medium onto which the ink image is formed. One of the problems that can lead to misregistration is "runout" of a roller over which the medium passes, meaning that the signal output by an encoder monitoring the roller has a period error due to deviation of the roller from true circular rotation.

U.S. Pat. No. 8,162,428 describes a method that compensates for runout errors in a web printing system. The method includes identifying runout error at a first roller driving a web of printable media, generating a runout compensation value corresponding to the identified runout error, identifying a velocity of the moving web with reference to encoder output corresponding to an angular velocity of the first roller and the generated runout compensation value, and delivering a firing signal to a print head proximate the first roller to energize the inkjet nozzles in the print head and eject ink onto the web at a position corresponding to the computed web velocity.

SUMMARY

Embodiments of the present invention that are described hereinbelow provide methods and apparatus for enhancing the precision of a digital printing system.

There is therefore provided, in accordance with an embodiment of the invention, printing apparatus, including a continuous blanket and a set of motorized rollers, which are coupled to advance the blanket at a constant speed through an image area of the apparatus. One or more print bars are configured to eject droplets of ink at respective locations onto the blanket in the image area so as to create an image. One or more monitoring rollers are positioned in proximity to the respective locations of the print bars and contact the blanket so as to be rotated by advancement of the blanket. Each monitoring roller includes an encoder configured to output a signal indicative of a rotation angle of the monitoring roller. A control unit is configured to collect, during a calibration phase, the signal from the encoder in each of the monitoring rollers over multiple rotations of the monitoring rollers while the blanket is advanced at the constant speed through the image area and to compute runout correction factors for the monitoring rollers responsively to the collected signal, and is further configured to synchronize, during an operational phase subsequent to the calibration phase, ejection of the droplets from the print bars using the computed runout correction factors.

In some embodiments, the one or more print bars comprise a first plurality of the print bars, and the one or more monitoring rollers comprise a second plurality of the monitoring rollers. In a disclosed embodiment, the plurality of print bars are configured to eject the ink of different, respective colors, and the control unit is configured to synchronize the ejection of the droplets with the advancement of the blanket so as to register the different colors in the image. Additionally or alternatively, the apparatus includes a transfer station, which is configured to transfer the image from the blanket to a print medium.

In some embodiments, the control unit is configured, during the calibration phase, to detect a deviation of the signal from the encoder relative to a clock signal having a predefined frequency, and to apply the runout correction factors in synchronizing the ejection of the droplets to the clock signal. In a disclosed embodiment, the control unit is configured to derive from the signal output by the encoder a sequence of ticks at a predefined angular separation, and to sample the signal synchronously with the ticks and to measure, based on the clock signal, variations in a time elapsed between the ticks.

Typically, the control unit is configured to compute and apply the runout correction factors as a function of an angle of rotation of each of the monitoring rollers. In some embodiments, the control unit is configured to detect, based on the signal, variations in a speed of rotation of each of the monitoring rollers as a function of the angle of rotation and to compute the runout correction factors so as to compensate for the variations in the speed. In a disclosed embodiment, the runout correction factors for each monitoring roller are based on a ratio between an average speed of the rotation of the monitoring roller and a specific speed of rotation measured during the calibration phase in each of a multiplicity of angular sectors.

There is also provided, in accordance with an embodiment of the invention, a method for controlling a printer, which includes one or more print bars configured to eject droplets of ink at respective locations onto a moving blanket in an image area of the printer, thereby forming an image on the moving blanket. The method includes advancing the continuous blanket at a constant speed through the image area over one or more monitoring rollers, which are positioned in proximity to the respective locations of the print bars and contact the blanket so as to be rotated by advancement of the blanket, each monitoring roller including an encoder. A signal received from the encoder in each monitoring roller is indicative of a rotation angle of the monitoring roller. During a calibration phase, the signal is collected from the encoder in each of the monitoring rollers over multiple rotations of the monitoring rollers while the blanket is advanced at the constant speed through the image area. Runout correction factors are computed for the monitoring rollers responsively to the collected signal. During an operational phase subsequent to the calibration phase, ejection of the droplets from the print bars is synchronized using the computed runout correction factors.

There is additionally provided, in accordance with an embodiment of the invention, a printing system, including a continuous blanket and an image-forming station, which includes a set of motorized rollers, which are coupled to advance the blanket at a constant speed through an image area of the image-forming station. One or more print bars are configured to eject droplets of ink at respective locations onto the blanket in the image area so as to create an image on the blanket. One or more monitoring rollers are positioned in proximity to the respective locations of the print bars and contact the blanket so as to be rotated by advancement of the blanket. Each monitoring roller includes an encoder configured to output a signal indicative of a rotation angle of the monitoring roller. A transfer station is configured to transfer the image from the blanket to a print medium.

A control unit is configured to collect, during a calibration phase, the signal from the encoder in each of the one or more monitoring rollers over multiple rotations of the monitoring rollers while the blanket is advanced at the constant speed through the image area and to compute runout correction factors for the one or more monitoring rollers responsively to the collected signal. The controller is further configured to synchronize, during an operational phase subsequent to the calibration phase, ejection of the droplets from the one or more print bars using the computed runout correction factors.

There is further provided, in accordance with an embodiment of the invention, a method for controlling a printer, which includes advancing a continuous blanket at a constant speed through an image area of the printer over one or more monitoring rollers, which are positioned in proximity to respective locations of one or more print bars in the image area and contact the blanket so as to be rotated by advancement of the blanket. Each monitoring roller includes an encoder. A signal is received from the encoder in each monitoring roller indicative of a rotation angle of the monitoring roller. During a calibration phase, the signal from the encoder in each of the monitoring rollers is collected over multiple rotations of the monitoring rollers while the blanket is advanced at the constant speed through the image area. Runout correction factors are computed for the monitoring rollers responsively to the collected signal.

During an operational phase subsequent to the calibration phase, an image is formed on the blanket while advancing the blanket through the image area by ejecting droplets from the one or more print bars onto the blanket and synchronizing ejection of the droplets using the computed runout correction factors. The image is transferred from the blanket to a print medium. The present invention will be more fully understood from the following detailed description of the embodiments thereof, taken together with the drawings in which:

DETAILED DESCRIPTION OF EMBODIMENTS

Figure 1:
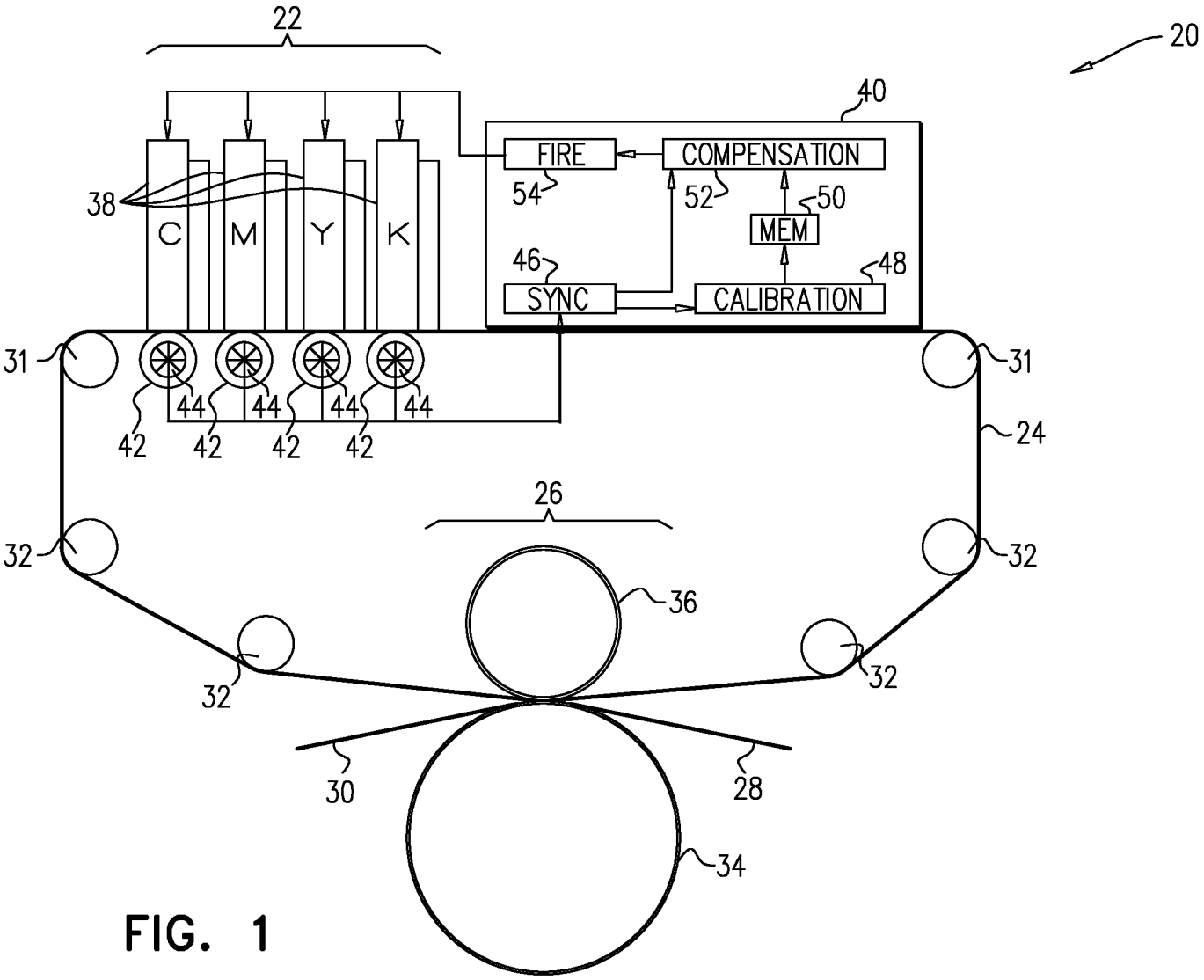
FIG. 1 is a schematic side view of a digital printing system, in accordance with an embodiment of the invention.

FIG. 1 is a schematic side view of a digital printing system 20, in accordance with an embodiment of the invention. This particular configuration of system 20 is shown by way of example, in order to illustrate certain problems that are addressed by embodiments of the present invention and to demonstrate the application of these embodiments in enhancing the performance of such a system. Embodiments of the present invention, however, are by no means limited to this specific sort of example system, and the principles described herein may similarly be applied to other sorts of printing systems that are known in the art.

System 20 comprises an image forming station 22, which creates an image on a continuous, moving blanket 24, and a transfer station 26, which transfers the image from the blanket to a print medium. Blanket 24 in this example comprises an endless belt, which is advanced over a set of rollers 31, 32, for example as described in the above-mentioned PCT International Publication PCT/IB2013/051727. In the pictured example, rollers 31 are motorized in order to drive blanket 24, and the print medium comprises sheets 28 of a suitable substrate, such as paper or plastic. Sheets 28 are captured and pressed against blanket 24 between an impression cylinder 34 and a pressure cylinder 36 (also referred to as a blanket cylinder), causing the image to be transferred from blanket 24 to output sheets 30. Alternatively, the print medium may comprise a continuous roll of material.

Image forming station 22 comprises multiple print bars 38, which eject droplets of ink at respective locations onto blanket 24, under the command of a control unit 40, so as to print images on the blanket that will be transferred to sheets 28 in transfer station 26. Typically, each print bar 38 comprise a plurality of print heads (not shown), which eject ink of a different, respective color from each print bar. The print bars are spaced apart along blanket 24 in the area of image forming station 22 (referred to herein as the image area of system 20), and control unit 40 synchronizes the ejection of the droplets with the advancement of the blanket by rollers 31 so as to register the different colors in the image. Although four print bars 38 are shown in FIG. 1 (for printing cyan, magenta, yellow and black inks, i.e., CMYK, respectively in the pictured example), image forming station 22 may alternatively comprise a smaller or larger number of print bars, in a different order.

To ensure that droplet ejection is properly synchronized, image forming station 22 comprises a set of monitoring rollers 42, which are positioned in proximity to the respective locations of print bars 38. In the pictured example, monitoring rollers 42 are positioned on the lower side of blanket 24, opposite the locations of print bars 38 on the upper side of the blanket. Further details of an arrangement of this sort are described, for example, in the PCT Patent Application PCT/IB2016/051560, whose disclosure is incorporated herein by reference. Alternatively, however, other arrangements of the monitoring rollers may be used. Monitoring rollers 42 contact blanket 24 so as to be rotated by advancement of the blanket.

Each monitoring roller 42 comprises an encoder 44, which outputs a signal indicative of a rotation angle of the monitoring roller. During the operational phase of system 20, control unit 40 receives these signals as an indication of the precise motion of blanket 24 relative to each of print bars 38 and synchronizes the ejection of the droplets from the print bars according to the signals.

As explained below, however, the indications of blanket position that are provided by encoders 44 can be distorted by a number of factors, including runout of monitoring rollers 42. Therefore, in embodiments of the present invention, control unit 40 calibrates and compensates for position errors that would otherwise by caused by such distortion. Specifically, during a calibration phase of system 20, prior to the operational phase, control unit 40 collects signals from encoders 44 over multiple rotations of monitoring rollers 42 while blanket 24 is advanced at a constant speed, and uses the collected signals in computing runout correction factors. In the subsequent operational phase, control unit 40 uses these runout correction factors in compensating for the runout of monitoring rollers 42 so as to synchronize the ejection of droplets from print bars 38 with high precision.

To carry out these functions, control unit 40 comprises a synchronizer 46, which samples the signals that are output by encoders 44. In the present embodiment, synchronizer 46 processes these signals to generate a respective sequence of "ticks" at predefined angular intervals of the rotation of each encoder 44. For example, synchronizer 46 may sense the rising and falling edges of the signals output by each encoder 44 to generate 40,000 ticks per revolution of the corresponding roller 42, as is known in the art. Because of runout of rollers 42 and other error factors, these ticks may not occur at constant, precisely-spaced time intervals. In order to measure and compensate for these error factors, synchronizer 46 samples the output signals from encoders 44, relative to a stable clock signal, synchronously with the ticks.

During the calibration phase in system 20, calibration logic 48 in control unit 40 measures the variations in the time elapsed between the ticks sampled by synchronizer 46 for each of encoders 44. Calibration logic 48 thus detects deviations of the signals from each encoder 44 relative to the clock signal, which has a constant, predefined frequency. The calibration logic applies these deviations in computing runout correction factors for each encoder 44, which are stored in a memory 50. Further details of this calibration process are described hereinbelow.

During subsequent printing operation of system 20, compensation logic 52 in control unit 40 reads the runout correction factors from memory 50 and uses these factors in determining when to issue "fire" signals to print bars 38, so as to compensate for the runout error in the timing of the ticks generated by synchronizer 46 in response to the signals output by encoders 44. In this manner, compensation logic 52 outputs instructions to a print bar drive circuit 54, indicating precisely the times at which the drive circuit should issue the "fire" signal to each of print bars 38 in order to precisely synchronize the ejection of the droplets to the clock signal, notwithstanding runout errors in rollers 42.

Control unit 40 typically comprises a general-purpose computer processor, which has suitable input and output interface and is programmed in software to carry out the functions that are described herein. Additionally or alternatively, at least some of the functions of control unit 40 are carried out by suitable hardware logic circuits, including high-speed timing, sampling, and signal generation circuits. These circuits may be implemented using hard-wired and/or programmable logic components. Although control unit 40 is shown in FIG. 1 as a unitary block, in practice the functions of the control unit may be distributed among multiple processors and circuits, which may be deployed at different locations in system 20. The term "control unit" in the present description and in the claims should be understood as covering these sorts of distributed implementations, as well.

Figure 2A:
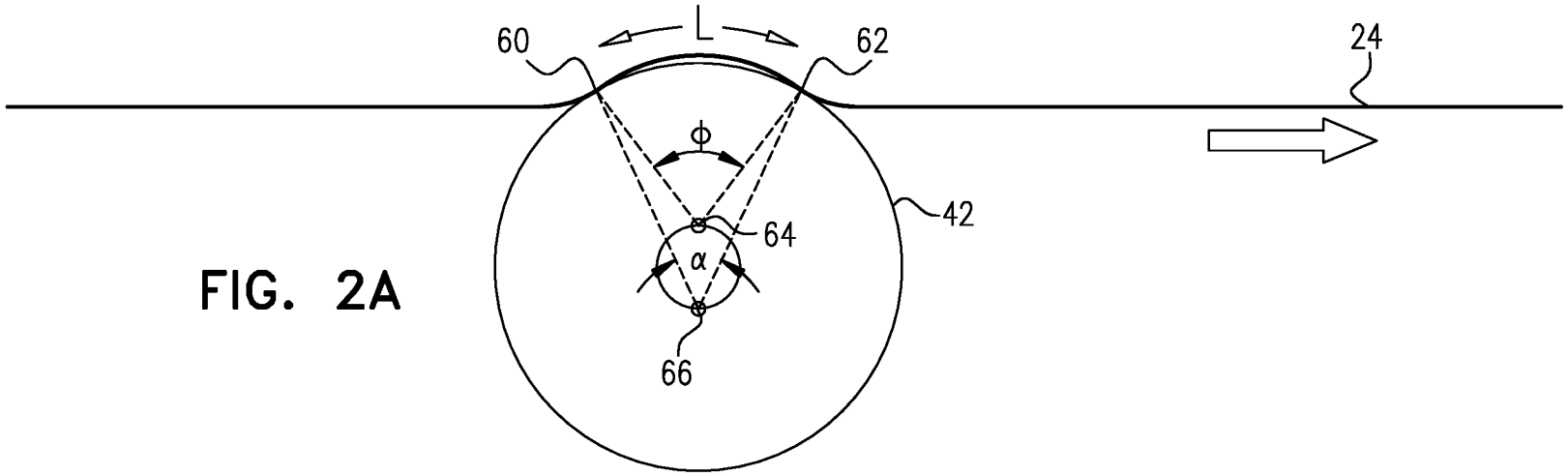
FIG. 2A is a schematic detail view of a roller and blanket in the system of FIG. 1.
Figure 2B:
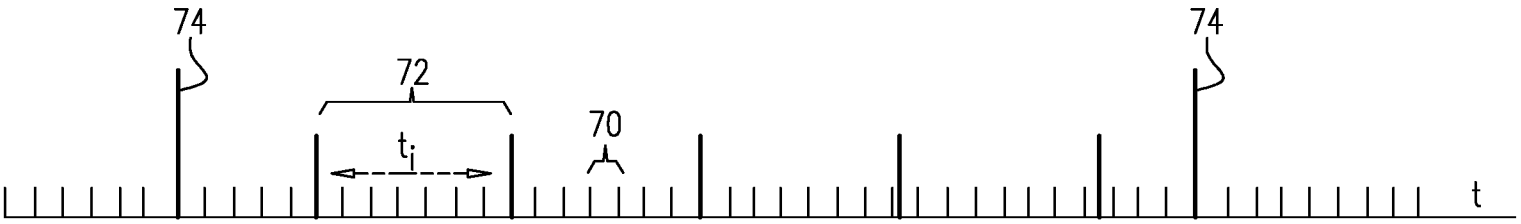
FIG. 2B is a timing diagram that schematically shows signals generated during operation of the system of FIG. 1.

Reference is now made to FIGS. 2A and 2B, which schematically illustrate a model of the operation of monitoring rollers 42 and encoders 44 that is used in generating runout correction factors, in accordance with an embodiment of the invention. FIG. 2A is a schematic detail view of monitoring roller 42 and blanket 24, while FIG. 2B is a timing diagram that schematically shows signals generated during operation of system 20. Although only a single roller 42 and the signals from the corresponding encoder 44 are illustrated in FIGS. 2A and 2B, control unit 40 uses the model illustrated in these figures in calibrating and compensating for runout in each of the rollers individually.

Roller 42 is assumed to have a diameter R and to engage blanket 24 between a pair of circumferential points 60 and 62, separated by a circumferential distance L. In the pictured example, the shaft of roller 42 is not rotating exactly in line with the intended axis, resulting in eccentric rotation, which is a form of runout. Runout error can also occur when roller 42 is slightly elliptical rather than circular in cross-section, or is mounted slightly off-center, or wobbles in some other manner, so that the effective radius of the roller varies with angle over each rotation. (Encoders 44 may also have small imperfections in their angular readings, with an effect that is similar to mechanical runout errors.) In general, each one of rollers 42 will have its own runout error, which is different in magnitude and angular dependence from those of the other rollers. These errors, if not corrected, lead to inaccuracy in the readings made by control unit 40 of the distance traversed by blanket 24 as it passes over each of rollers 42 and can thus affect the relative timing of the firing signals issued to print bars 38, resulting in misregistration in the printed images.

In the example shown in FIG. 2A, the axis of roller 42 wobbles cyclically over an elliptical path that includes an upper point 64 and a lower point 66, separated by a distance $\Delta R$. At upper point 64, the angular spread between circumferential points 60 and 62 is $\phi$, whereas at lower point 66 the angular spread has the smaller value a. Although the circumferential distance L between points 60 and 62 is shown in FIG. 2A as though it were a constant value, in actuality it varies between $L_{MAX}=R*\varphi$ and $L_{MIN}=R*\alpha$, giving an encoder error of $0.5R(\varphi-\alpha)$. In terms of encoder 44 on roller 42, the elapsed number of ticks in rotation between points 60 and 62 about upper point 64 will be greater than the number of ticks in the rotation about lower point 66 by a multiplicative runout factor $$\delta = \frac{\Delta R}{R}.$$

As shown in FIG. 2B, control unit 40 uses a stabilized clock, having clock ticks separated by a clock cycle 70, which is typically much smaller than the interval between the encoder ticks. Synchronizer 46 meanwhile receives encoder ticks, which are separated by encoder intervals ($t_i$) 72, and reads the clock value at each tick. As explained above and illustrated in FIG. 2B, encoder intervals 72 vary due to runout of roller 42 (as well as other factors). Calibration logic 48 measures and models this variation and stores correction factors in memory 50, which are then applied by compensation logic 52 in generating fire pulses 74 to print bars 38 at the appropriate times.

Figure 3:
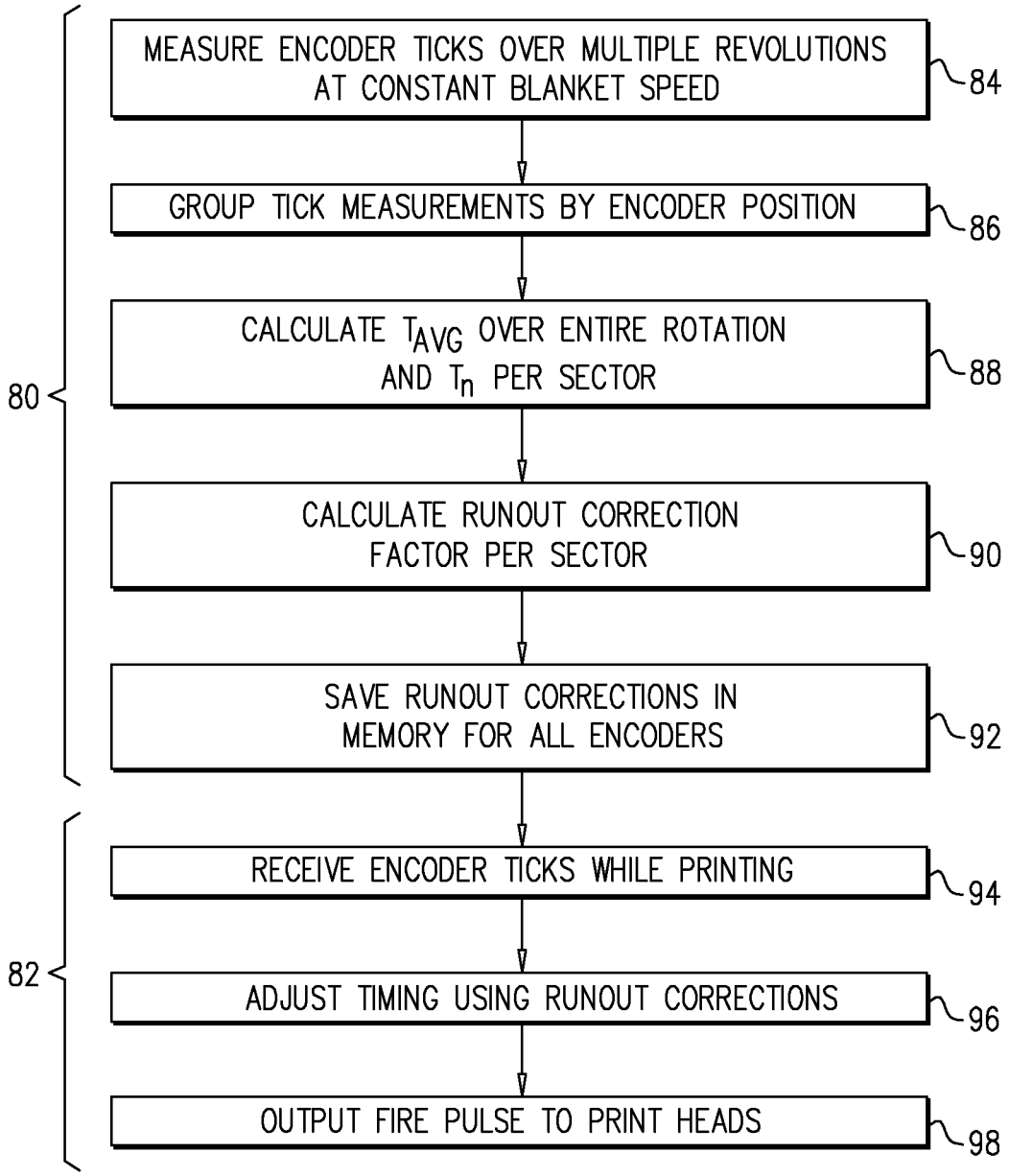
FIG. 3 is a flow chart that schematically shows a method for correction of runout error, in accordance with an embodiment of the invention.

FIG. 3 is a flow chart that schematically shows a method for correction of runout error, in accordance with an embodiment of the invention. Control unit 40 applies this method in order to compute and apply the appropriate runout correction factors as a function of an angle of rotation of each of monitoring rollers 42, as indicated by the corresponding encoders 44. The correction factors are derived by control unit 40 itself based on signals output by encoders 44 while running blanket 24. There is no need for any sort of specialized measurement tools or for test printing and analysis as part of the runout calibration process.

For the sake of concreteness and clarity, the method of FIG. 3 is described hereinbelow with reference to the elements of system 20. The principles of this method, however, are not limited to this particular system configuration and can be applied, mutatis mutandis, in other sorts of printing systems that require precise timing control with compensation for encoder error. In particular, although system 20 is shown in FIG. 1 as including four print bars 38, with four monitoring rollers 42 and encoders 44, the principles embodied in this system and in the present method may similarly be applied to printing system having larger or smaller numbers of print bars, monitoring rollers and corresponding encoders, including systems that include only a single print bar and/or a single monitoring roller and encoder. All such alternative embodiments are considered to be within the scope of the present invention.

The method of FIG. 3 is divided into two phases: a calibration phase 80, during which the runout correction factors are computed, and a subsequent operational phase 82, during which the corrections are applied. Calibration phase 80 is typically carried out before beginning the actual printing operation of system 20, and may be repeated at later times to compensate for changes in runout that can occur over time.

To start the calibration phase, synchronizer 46 samples and collects encoder ticks from each of encoders 44 over many rotations of rollers 42, while blanket 24 is advanced continuously at a constant speed, at a measurement step 84. It is advantageous that system 20 operate over sufficient time before beginning the measurements at step 84 in order to reach its normal operating temperature. When encoder measurements are made over many rotations under these conditions, temperature-related encoder errors will cancel out, as will various other possible errors due to transient speed variations of blanket 24, leaving only the runout errors to correct.

Each measurement made at step 84 gives the duration of encoder interval 72 for a given tick (in terms of clock cycles 70) at a given encoder position (i.e., a given angle of rotation). Calibration logic 48 groups these measurements as a function of position, at a measurement grouping step 86. For convenience of calibration, the 360° range of rotation angles can be divided into N angular sectors, for example N=32, and the encoder measurements grouped in each sector.

Based on the encoder measurements, calibration logic 48 computes an average sector tick duration $T_n$ for each sector n (n=1, . . . , N), as well as an average tick duration $T_{AVG}$ over all sectors, at an averaging step 88. As the average tick durations are inverse to the average velocities, this computation is equivalent to detecting, based on the encoder signals, variations in the circumferential speed of rotation V of each of monitoring rollers 42 as a function of the angle of rotation.

Calibration logic 48 then computes a runout correction factor $K_n$ for each sector so as to compensate for these variations in the circumferential speed, at a correction computation step 90. These runout correction factors for each monitoring roller 42 are based on the ratio between the average speed of the rotation of the monitoring roller and the specific speed of rotation measured during the calibration phase in each of the angular sectors, i.e., $$\frac{V_{AVG}}{V_n} = \frac{T_n}{T_{AVG}} = 1 + \delta = K_n$$

Calibration logic 48 saves the runout correction factors, per encoder and per sector, in memory 50, at a calibration storage step 92.

To begin operational phase 82, system 20 is loaded with sheets 28, and digital print images are fed to control unit 40, indicating which of print bars 38 should be fired at each pixel of the images. As blanket 24 advances and rollers 42 rotate, synchronizer 46 receives signals from encoders 44, at a tick input step 94. Compensation logic 52 identifies each tick with the angular sector to which it belongs and thus reads the appropriate correction factor $K_n$ from memory 50. Based on the correction factors, compensation logic 52 adjusts the measured tick interval, i.e., increases or decreases the interval by the factor $K_n$, thus effectively advancing or delaying the measured tick timing, in order to correct for the runout that was found in calibration phase 80, at a timing adjustment step 96. Compensation logic 52 inputs a signal to drive circuit 54 indicating the adjusted time, and drive circuit 54 accordingly outputs fire pulses to the appropriate print bars 38, at a firing step 98. This process continues over all encoder ticks and pixels printed by system until operation is complete.

It will be appreciated that the embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

The invention claimed is:

1. Printing apparatus, comprising:

a continuous blanket;

a set of motorized rollers, which are coupled to advance the blanket at a constant speed through an image area of the apparatus;

one or more print bars, which are configured to eject droplets of ink at respective locations onto the blanket in the image area so as to create an image;

one or more monitoring rollers, which are positioned in proximity to the respective locations of the print bars and contact the blanket so as to be rotated by advancement of the blanket, each monitoring roller comprising an encoder configured to output a signal indicative of a rotation angle of the monitoring roller, the signal comprising a sequence of encoder ticks; and a control unit, which is configured to collect, during a calibration phase, the signal from the encoder in each of the one or more monitoring rollers over multiple rotations of the monitoring rollers while the blanket is advanced at the constant speed through the image area and to compute runout correction factors for the one or more monitoring rollers responsively to the collected signal, and which is further configured to synchronize, during an operational phase subsequent to the calibration phase, ejection of the droplets from the one or more print bars using the computed runout correction factors, wherein the control unit is configured, during the calibration phase, to:

(i) read clock ticks of a clock having a predefined frequency;

(ii) compare the encoder ticks to the clock ticks of the clock, so as to detect a deviation of the signal from the encoder; and (iii) apply the runout correction factors in synchronizing the ejection of the droplets to the clock ticks.

2. The apparatus according to claim 1, wherein the one or more print bars comprise a first plurality of the print bars, and wherein the one or more monitoring rollers comprise a second plurality of the monitoring rollers.

3. The apparatus according to claim 2, wherein the first plurality of print bars are configured to eject the ink of different, respective colors, and wherein the control unit is configured to synchronize the ejection of the droplets with the advancement of the blanket so as to register the different colors in the image.

4. The apparatus according to claim 1, and comprising a transfer station, which is configured to transfer the image from the blanket to a print medium.

5. The apparatus according to claim 1, wherein the control unit is configured to sample the signal synchronously with the encoder ticks and to measure, based on the clock ticks, variations in a time elapsed between the encoder ticks.

6. The apparatus according to claim 1, wherein the control unit is configured to compute and apply the runout correction factors as a function of an angle of rotation of each of the one or more monitoring rollers.

7. The apparatus according to claim 6, wherein the control unit is configured to detect, based on the signal, variations in a speed of rotation of each of the one or more monitoring rollers as a function of the angle of rotation and to compute the runout correction factors so as to compensate for the variations in the speed.

8. A method for controlling a printer, which includes one or more print bars configured to eject droplets of ink at respective locations onto a moving blanket in an image area of the printer, thereby forming an image on the moving blanket, the method comprising:

advancing the continuous blanket at a constant speed through the image area over one or more monitoring rollers, which are positioned in proximity to the respective locations of the one or more print bars and contact the blanket so as to be rotated by advancement of the blanket, each monitoring roller comprising an encoder;

receiving a signal from the encoder in each monitoring roller indicative of a rotation angle of the monitoring roller, the signal comprising a sequence of encoder ticks;

during a calibration phase, collecting the signal from the encoder in each of the monitoring rollers over multiple rotations of the monitoring rollers while the blanket is advanced at the constant speed through the image area;

computing runout correction factors for the monitoring rollers responsively to the collected signal; and during an operational phase subsequent to the calibration phase, synchronizing ejection of the droplets from the print bars using the computed runout correction factors;

wherein computing the runout correction factors comprises:

(i) reading clock ticks of a clock having a predefined frequency;

(ii) comparing the encoder ticks to the clock ticks of the clock, for detecting a deviation of the signal from the encoder; and wherein synchronizing the ejection of the droplets comprises applying the runout correction factors in synchronizing the ejection of the droplets to the clock ticks.

9. The method according to claim 8, wherein the one or more print bars comprise a first plurality of the print bars, and wherein the one or more monitoring rollers comprise a second plurality of the monitoring rollers.

10. The method according to claim 9, wherein the first plurality of the print bars eject different, respective colors of the ink, and wherein synchronizing the ejection of the droplets comprises synchronizing the ejection with the advancement of the blanket so as to register the different colors in the image.

11. The method according to claim 8, and comprising transferring the image from the blanket to a print medium.

12. The method according to claim 8, wherein computing the runout correction factors comprises calculating the runout correction factors as a function of an angle of rotation of each of the monitoring rollers.

13. The method according to claim 12, wherein calculating the runout correction factors comprises detecting, based on the signal, variations in a speed of rotation of each of the one or more monitoring rollers as a function of the angle of rotation and computing the runout correction factors so as to compensate for the variations in the speed.

14. The method according to claim 8, wherein detecting the deviation comprises sampling the signal synchronously with the encoder ticks, and measuring, based on the clock ticks, variations in a time elapsed between the encoder ticks.

15. A printing system, comprising:

a continuous blanket;

an image-forming station, which comprises:

a set of motorized rollers, which are coupled to advance the blanket at a constant speed through an image area of the image-forming station;

one or more print bars, which are configured to eject droplets of ink at respective locations onto the blanket in the image area so as to create an image on the blanket; and one or more monitoring rollers, which are positioned in proximity to the respective locations of the print bars and contact the blanket so as to be rotated by advancement of the blanket, each monitoring roller comprising an encoder configured to output a signal indicative of a rotation angle of the monitoring roller, the signal comprising a sequence of encoder ticks;

a transfer station, which is configured to transfer the image from the blanket to a print medium; and a control unit, which is configured to collect, during a calibration phase, the signal from the encoder in each of the one or more monitoring rollers over multiple rotations of the monitoring rollers while the blanket is advanced at the constant speed through the image area and to compute runout correction factors for the one or more monitoring rollers responsively to the collected signal, and which is further configured to synchronize, during an operational phase subsequent to the calibration phase, ejection of the droplets from the one or more print bars using the computed runout correction factors, wherein the control unit is configured, during the calibration phase, to:

(i) read clock ticks of a clock having a predefined frequency;

(ii) compare the encoder ticks to the clock ticks of the clock, so as to detect a deviation of the signal from the encoder; and (iii) apply the runout correction factors in synchronizing the ejection of the droplets to the clock ticks.

* * * * *